US006004117A

United States Patent [19]

Brunk

[11] Patent Number: 6,004,117

[45] Date of Patent: Dec. 21, 1999

[54] DISPLACEMENT PUMP

[75] Inventor: Donald Harvey Brunk, Wilmington, Del.

[73] Assignee: Qualicon Inc., Wilmington, Del.

[21] Appl. No.: 09/315,185

[22] Filed: May 20, 1999

Related U.S. Application Data

[60] Provisional application No. 60/086,272, May 29, 1998.

[51] Int. Cl.[6] ..... F04B 13/00

[52] U.S. Cl. ..... 417/488; 417/498; 92/79

[58] Field of Search ..... 417/488, 498, 417/490; 92/79, 60.5, 129

[56] References Cited

U.S. PATENT DOCUMENTS

| | | | |
|---|---|---|---|
| 1,470,863 | 10/1923 | Morse | 417/498 |
| 1,519,478 | 12/1924 | Beaton | 417/398 |
| 1,760,070 | 5/1930 | Kinsella | 92/79 |
| 1,993,759 | 3/1935 | Stockmeyer | 92/79 |
| 2,421,843 | 6/1947 | Meitzler | 417/498 |
| 2,867,375 | 1/1959 | Petersen | 417/488 |
| 2,891,718 | 6/1959 | Hall et al. | 417/488 |
| 3,249,052 | 5/1966 | Karlak | 417/498 |
| 3,625,297 | 12/1971 | Worman | 92/79 |
| 3,802,805 | 4/1974 | Roeser | 417/398 |
| 4,568,249 | 2/1986 | Todd | 417/238 |
| 4,941,808 | 7/1990 | Qureshi et al. | 417/415 |
| 5,697,287 | 12/1997 | Fassbender | 92/79 |

*Primary Examiner*—Charles G. Freay
*Assistant Examiner*—Robert Z. Evora

[57] ABSTRACT

An improved displacement pump is provided with flow path means preventing hysteresis-causing bubbles from accumulating in piston clearances.

2 Claims, 2 Drawing Sheets

DISPLACEMENT PUMP

This application claims the benefit of U.S. Provisional Application Ser. No. 60/086,272 filed on May 29, 1998.

BACKGROUND OF THE INVENTION

This invention relates to the field of fluid pumps and particularly to pumps providing precise metering of relatively small volumes.

The technology of fluid pumping has its roots in antiquity. The piston pump, in which a piston of limited depth closely fits within a cylinder, with or without adapting packing, is an extremely old structure. Linear extension of a pump shaft translates the piston to displace a volume of fluid equal to the cross-sectional area moved and the length of the stroke. Displacement pumps, with which the instant invention is concerned, are a variant of the piston pump in which a piston of extended depth, and which does not closely fit the bore of the cylinder, moves into the cylinder and displaces a volume equal to the volume of the piston moved into the cylinder. Displacement pumps have the inherent advantage of having the packing placed at the end of the cylinder where it can be more effective and adjustable. Metering precision in both of the types of pumps described depends on precision of the stroke length.

U.S. Pat. No. 4,941,808 describe a multi-mode, differential fluid displacement pump which can provide at least two different measured doses. The pump has a chamber in which are mounted first and second diameter pistons which define first and second volumes for reciprocation within the chamber. Reciprocation means are provided to deliver predetermined volumes by movement of either or both of the two pistons. By using two fluid displacement pistons, accurate metering of a small quantity of sample and a larger quantity of reagent can be done in one unit. The elongated pistons of such a pump are aligned axially and move separately or together.

A problem known as flow hysteresis is known to occur when the multimode pumps are used to meter quite small and precise volumes. Flow hysteresis is evidenced when the pump shaft is extended a limited amount and the responsive volume delivered is less than predicted by simple calculation. This anomaly is due to the introduction of compressibility into a fluid system assumed to be non-compressible by the presence of one or more bubbles of gas (usually air) trapped at a dead space in the flow system.

It is, therefore, an object of the present invention to provide an improved displacement pump which provides more precise and predictable metered volumes by eliminating hysteresis caused by trapped gas bubbles.

SUMMARY OF THE INVENTION

In a displacement pump comprising a block defining a bore with at least one piston located within said bore, means for sealing a lower end of said bore, means for sealing an upper end of said bore, a fluid inlet, a fluid outlet in proximity to said upper sealing means, means to move said at least one piston, and a fluid guiding path extending said bore in a limited radial area between said fluid inlet and said fluid outlet; the improvement comprising said fluid guiding path being positioned in a region diametrically opposed to said fluid outlet, and said improvement further comprising a circumferential groove extending said bore in an area between said fluid guiding path and said fluid outlet, said circumferential groove being in proximity to said upper sealing means.

DETAILED DESCRIPTION OF THE EMBODIMENTS

Figure 1:
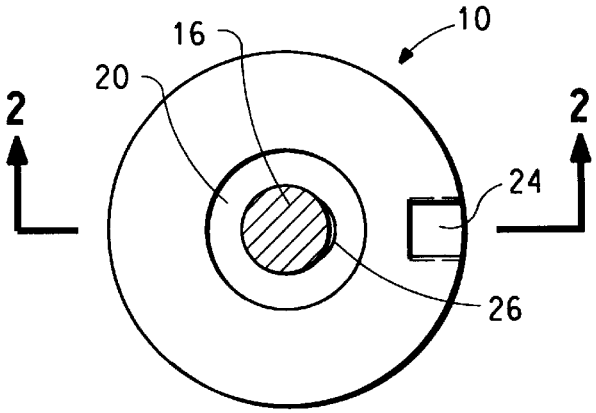
FIG. 1 (PRIOR ART)
FIG. 1 is a transverse sectioned view of a prior art displacement pump block with pistons in place.
Figure 2:
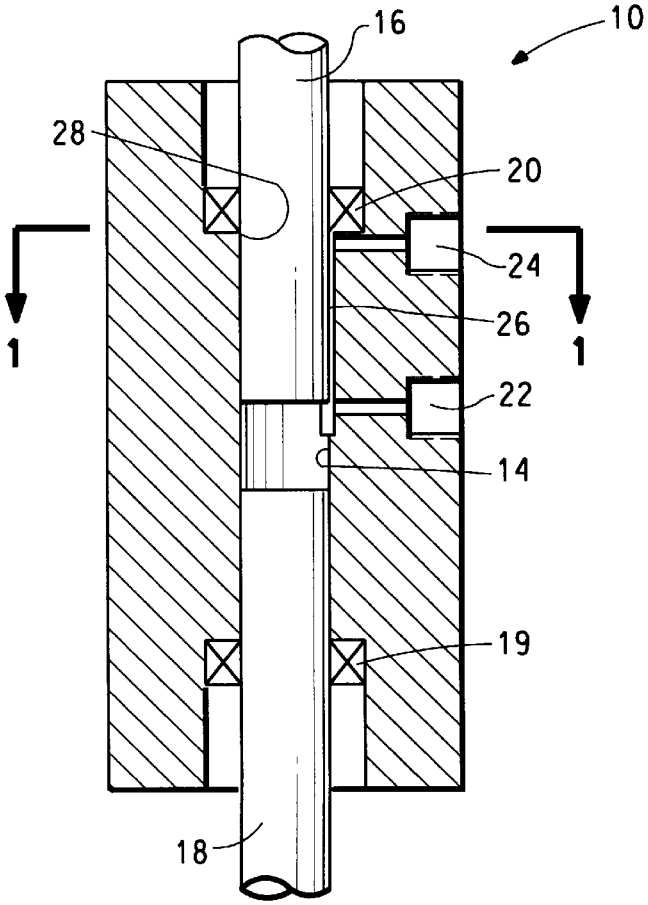
FIG. 2 (PRIOR ART)
FIG. 2 is a longitudinal sectioned view of the prior art pump of FIG. 1 on the line 2—2 of FIG. 1.
Figure 3:
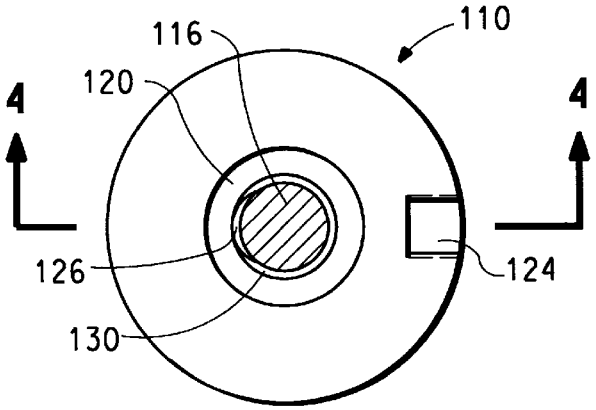
FIG. 3 is a transverse sectioned view of a pump block of a displacment pump in accordance with the present invention with pistons in place.
Figure 4:
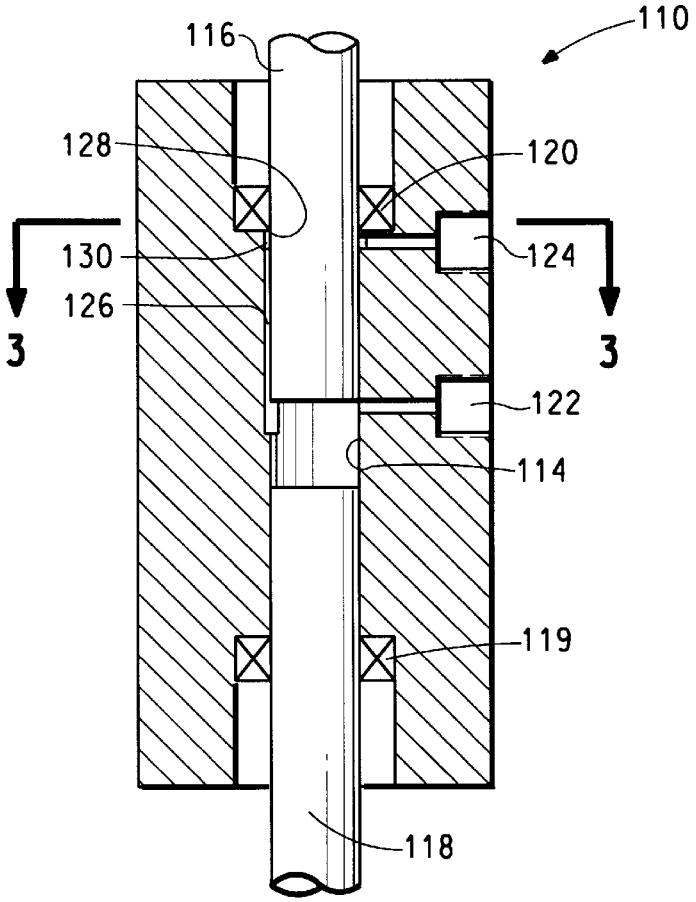
FIG. 4 is a longitudinal sectioned view of the pump block of FIG. 3 taken on the line 4—4 of FIG. 3.

FIGS. 3 and 4 show certain elements an embodiment of an improved displacement pump of the present invention. FIGS. 1 and 2 are illustrative of the prior art. All other elements of a working pump and associated structures, in both the pump of the present invention and the prior art, are as shown and described in U.S. Pat. No. 4,941,808, the entire disclosure of which is incorporated herein by reference.

With reference to FIGS. 1 and 2, clyindrical block 10 defines bore 14 having fluid inlet 22 and fluid outlet 24 for introducing and discharging fluid respectively. Upper piston 16 is mounted within bore 14 and lower piston 18 is mounted within bore 14 in axial alignment with upper piston 16. Bore 14 is sealed by lower stationary seal 19 at one end and by upper stationary seal 20 at a second end spaced above the first end. Seals 19 and 20 isolate fluid within bore 14 between and around pistons 16 and 18, and the fluid communicates outside bore 14 through fluid inlet 22 and fluid outlet 24. Not shown are elements of an external fluid handling system.

A DRD™ Mini-Pump available from DRD Diluter Corporation of Danvers, Mass., is illustrative of the prior art. The DRD™ Mini-Pump and its associated drive/control components fits into 16.5×10.2×5.8 cm (6.5 by 4.0 by 2.3 inch) space. Pump block 10 is about 6.4 cm (2.5 inches) long. Piston 16, which is fabricated from a ceramic, has a diameter of 0.785 cm (0.3090 inch); only 0.008 cm (0.003 inch) less than the diameter of piston 18. This difference provides the fine metering available from such a differential pump. When piston 18 is moved upwards from the illustrated position shown in the figures (by mechanical means driven by a stepping motor, neither being shown), the relatively larger volume of the area of the cross-section of piston 18 times the stroke length is expelled through fluid outlet 24 after appropriate priming and valving having been done. When piston 18 contacts piston 16 and moves it upwards against the force of a downwardly directed compression spring (not shown), the volume expelled becomes the difference between the areas of the two pistons times the stroke length. Thus a considerably smaller volume is metered. The pump is rated for delivery of 13 $\mu$l in dual resolution mode, and 1000 $\mu$l in single resolution mode.

In FIG. 1, fluid guiding path 26 is shown as being diametrically on the same side of bore 14 as fluid inlet 22 and fluid outlet 24. Fluid guiding path 26 serves to move fluid without the excessive pressure drop that would occur if the fluid being expelled were forced to flow entirely through the extremely tight clearance of the pump. In the DRD™ Mini-Pump described above, piston 18 has a clearance from bore 14 of only 0.01 cm (0.004 inch).

While using a DRD™ Mini-Pump in which the cylinder block was fabricated from transparent acrylic resin, bubbles were seen to congregate in region 28 near upper seal 20 and opposite fluid outlet 24. Region 28 is an area where bubbles tend to accumulate because it is a region where very little liquid flow occurs. A bubble in a metering system such as this pump provides will expand and contract as pressure changes in the pump creating hysteresis and reducing overall precision of the metered volume.

FIGS. 3 and 4, show an improved pump of the present invention. The elements of the present invention that correspond to those in FIGS. 1 and 2 are designated by numbers that are similar to the numbers used for the prior art pump of FIGS. 1 and 2, with a "1" prefix (i.e., 124 vs. 24; 120 vs. 20, etc.). Although not limited to such a shape, in the embodiment of the present invention shown in FIGS. 3 and 4, block 110 is shown as cylindrical. Block 110 differs from block 10 of FIGS. 1 and 2 in that bore 114 is not extended diametrically on the same side of bore 114 as fluid inlet 122 and fluid outlet 124, but instead bore 114 is extended in such a manner as to direct increased fluid flow to region 128 residing on the side of bore 114 opposite fluid outlet 124 and to sweep any potentially hysteresis-causing bubbles from region 128 to fluid outlet 124. Thus, the present invention works by forcing flow to region 128 which but for the location of fluid guiding path 126 and the presence of circumferential groove 130 would have been a stagnant area where bubbles could be trapped, as is region 28 of the prior art.

The improvement of the present invention is provided by a fluid guiding path 126 located diametrically opposite fluid outlet 124 which extends bore 14 in a limited radial area from generally below the plane of fluid inlet 122 to generally above the plane of fluid outlet 124 encompassing region 128 and in proximity to upper seal 120. Fluid guiding path 126 can be readily provided by milling a small degree of material in the limited radial area from the inner wall of block 110 thus slightly increasing the clearance on that side of piston 116 which is diametrically opposed to fluid outlet 124. The improvement of the present invention is further provided by circumferential groove 130 formed within the inner wall of block 110 in proximity to upper seal 120 and extending the bore in a limited circumferential area which surrounds a portion of piston 116 and serving to provide a path wherein fluid can sweep bubbles from region 128 to fluid outlet 124. Thus, circumferential groove 130 is in fluid communication with fluid guiding path 126 and fluid outlet 124. In pumps of the present invention fabricated from acrylic material, no bubbles were seen to accumulate below upper seal 120 in region 128 and no hysteresis effects were observed.

The present invention is particularly adaptable to the multi-mode differential fluid displacement pumps and is particularly advantageous in situations where such pumps will be used to meter quite small and precise volumes. Using a pump of the present invention, the minimum volume that can be accurately dispensed is around 2 $\mu$l.

What is claimed is:

1. In a displacement pump comprising a block defining a bore with at least one piston located within said bore, means for sealing a lower end of said bore, means for sealing an upper end of said bore, a fluid inlet, a fluid outlet in proximity to said upper sealing means, means to move said at least one piston, and a fluid guiding path extending said bore in a limited radial area between said inlet and said outlet; the improvement comprising said fluid guiding path being positioned in a region diametrically opposed to said fluid outlet, and said improvement further comprising a circumferential groove extending said bore in an area between said fluid guiding path and said fluid outlet, said circumferential groove being in proximity to said upper sealing means.

2. The pump of claim 1 wherein said pump is a multi-mode differential pump having two pistons.

* * * * *